US008333236B2

(12) United States Patent
Guidry et al.

(10) Patent No.: US 8,333,236 B2
(45) Date of Patent: Dec. 18, 2012

(54) AUXILIARY CONDUIT CUTTING APPARATUS

(75) Inventors: Christopher W. Guidry, Spring, TX (US); Anthony C. Zavesky, Houston, TX (US); Joshua C. Joerg, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 409 days.

(21) Appl. No.: 12/651,132

(22) Filed: Dec. 31, 2009

(65) Prior Publication Data

US 2010/0294478 A1 Nov. 25, 2010

Related U.S. Application Data

(63) Continuation-in-part of application No. 12/469,388, filed on May 20, 2009, now Pat. No. 8,181,699.

(51) Int. Cl.
*E21B 43/11* (2006.01)

(52) U.S. Cl. ..... 166/55.3

(58) Field of Classification Search ..... 166/55, 166/55.1, 55.3, 55.6, 297, 376, 377; 72/112, 72/391; 30/92, 94
See application file for complete search history.

(56) References Cited

U.S. PATENT DOCUMENTS

| | | | |
|---|---|---|---|
| 4,160,478 | A | 7/1979 | Calhoun et al. |
| 4,981,177 | A | 1/1991 | Carmody et al. |
| 6,789,627 | B2 | 9/2004 | Leismer |
| 6,997,262 | B2 | 2/2006 | Palmer et al. |
| 2002/0162667 | A1 | 11/2002 | Ingram et al. |
| 2005/0133227 | A1 | 6/2005 | Wills |

FOREIGN PATENT DOCUMENTS

| | | | |
|---|---|---|---|
| WO | 0188330 | A1 | 11/2001 |
| WO | 2008085062 | A1 | 7/2008 |

*Primary Examiner* — William P Neuder
*Assistant Examiner* — Kipp Wallace
(74) *Attorney, Agent, or Firm* — Steve Rosenblatt

(57) ABSTRACT

A cutting assembly for external conduits on a tubing string or main tubular conduit features at least one breakaway in the string that can be severed with a tensile force. Preferably each external conduit is run through a cutter housing that is integral with a passage having threaded end connections. While in some scenarios it is preferred that the main tubular conduit is severed below the cutting assembly thus allowing the cutting apparatus to be retrieved with the upper portions of the cut main tubular conduit and external longitudinal member(s), in other circumstances it may be desired that the main tubular conduit is severed above the cutting assembly allowing the cutting apparatus to be left "downhole" with the lower portion of the cut main tubular conduit and the BHA. The cutter knife assembly chambers or channels can be in banks that are axially spaced using bypass channels to access lower banks. The cutter knife assembly and associated channels can be mirror images so that the external conduits can be cut regardless of where the tubing string is severed and one or more conduits can be cut with a single cutter assembly.

30 Claims, 9 Drawing Sheets

AUXILIARY CONDUIT CUTTING APPARATUS

RELATED APPLICATION

This application is a continuation in part of U.S. patent application Ser. No. 12/469,388, filed on May 20, 2009 entitled Auxiliary Conduit Cutting Apparatus.

FIELD OF THE INVENTION

The field of the invention is cutting auxiliary conduits associated with a bottom hole assembly (BHA) when the string supporting the BHA is separated and pulled "out of the hole" from an underground or underwater encasement or caisson.

BACKGROUND OF THE INVENTION

In many applications in oil or gas wells, a main tubular conduit, such as production tubing, is run into the wellbore with a BHA attached. The BHA may have a wireline, control line, vent line, or other such longitudinal member(s) attached to it. Typically, these wireline, control line, vent line, or other such longitudinal member(s) will be run externally to the production tubing. Such longitudinal members will be referred to as external longitudinal members herein. Often, there may be several such external longitudinal members run into the wellbore along with, and external to, the production tubing or other main tubular conduit.

In some circumstances, it becomes necessary to cut or sever the main tubular conduit at a point downhole, and to pull the tubular conduit back out of the hole, leaving the severed lower portion of tubular conduit, and the BHA attached thereto, in the wellbore. This also necessitates the cutting of the external longitudinal members, preferably without a separate operation for running specialized cutting equipment into the wellbore. It is also desirable to be able to cut the wireline, control line, vent line, or other such longitudinal member(s) somewhere downhole as close as possible to the point at which the tubular conduit is cut, to salvage as much as possible of the external longitudinal member and keep the wellbore as open as possible. While in some scenarios it is preferred that the main tubular conduit is severed below the cutting apparatus thus allowing the cutting apparatus to be retrieved with the upper portions of the cut main tubular conduit and external longitudinal member(s), in other circumstances it may be desired that the main tubular conduit is cut above the cutting apparatus allowing the cutting apparatus to be left "downhole" with the lower portion of the cut main tubular conduit and the BHA.

A prior design described in U.S. Pat. No. 6,997,262 provided a method and apparatus for severing one or more external longitudinal members, with a cutting tool attached to the main tubular conduit, above the BHA. The cutting tool consisted of a cutter body which was clamped in place on the external surface of the main tubular conduit, such as by capturing the cutter body between two couplers threaded onto the tubular conduit. Inside the cutter body was one cutter knife which slid longitudinally relative to the cutter body. This cutter knife is fixedly attached to the external longitudinal member, such as by being clamped thereto. The external longitudinal member or members are routed through the cutter body so as to be exposed to the cutting edge of the knife or knives. If there are several knives, they can be oriented facing each other, and the external longitudinal member or members are routed between the cutting edges on the cutter knives. A surface on each cutter knife abuts an actuating surface on the cutter body, with this actuating surface sloping downwardly and transversely to the longitudinal axis of the cutting tool. If there are several cutter knives, there can be a single conical actuating surface, or several actuating surfaces.

If it became necessary to sever the main tubular conduit and retrieve the upper portion, this operation was first accomplished below the cutting tool. The upper portion of the tubular conduit, as well as the cutting tool, is then pulled upwardly, or uphole, to retrieve it from the well.

After the tubular conduit is severed, pulling upwardly on the tubular conduit will also lift the cutter body upwardly, or in an uphole direction. At the same time, the external longitudinal member to which the cutter knives are attached is still attached to the BHA, thereby holding the cutter knives in place longitudinally in the well bore. The uphole movement of the cutter body relative to the cutter knives caused the sloping actuating surfaces on the cutter body to engage the abutting surfaces on the cutter knives and forced the cutter knives toward each other, or inwardly. This drove the cutting edges of the cutter knives through the external longitudinal member or members, severing them. This allowed the upper portion(s) of the cut external longitudinal member or members and the cutting tool to be simultaneously retrieved from the well bore.

As shown in FIG. 1, the apparatus 10 includes generally a cutter body 12, and one or more cutter knives 18, 20. The cutter body 12 has a longitudinal bore 14 therethrough, for passage of a tubular conduit TC to which the apparatus 10 of the present invention may be attached. For example, the cutter body 12 can be captured in place longitudinally on the tubular conduit TC by threading of couplers (not shown), as is known in the art, on the ends of the section of tubular conduit TC, above and below the cutter body 12.

The cutter body 12 has a generally longitudinal knife chamber 16 in which the cutter knives 18, 20 are slidably positioned. The cutter knives 18, 20 have clamping bodies 22, 24 near their upper ends. The clamping bodies 22, 24 can be fastened together, as shown better in FIG. 2, to clamp tightly around a longitudinal member, such as a wireline WL, which is positioned externally to the tubular conduit TC. The clamping bodies 22, 24 can be bolted together at mating surfaces 50, as is well known in the art. The bolts and bolt holes are omitted in these views, for the sake of clarity.

The cutter knives 18, 20 have thinner mid-sections 26, 28, which can flex to allow the lower ends of the knives 18, 20 to deflect inwardly, as will be explained below. Cutter blades 30, 32 are mounted on the knives 18, 20 near their lower ends, with the blades 30, 32 having cutting edges 34, 36 facing each other, or facing inwardly. FIG. 3 shows this orientation of the cutting edges 34, 36.

As seen in FIGS. 1 through 3, a wireline passage 38 is provided longitudinally through the cutter body 12, as is a vent line passage 40. Similarly, a passage could be provided for a control line or any other kind of external longitudinal member that may be in use next to the tubular conduit TC. These longitudinal member passages, 38 and 40, position the external longitudinal members VL, WL between the cutter knives 18, 20, and specifically between the cutting edges 34, 36. As shown in FIG. 3, one cutting edge 36 can be V-shaped to centralize the vent line VL and the wireline WL between the cutting edges 34, 36.

A set of teeth or serrations 42 can be provided within the wireline passage 38, to facilitate holding the cutter knives 18, 20 in position longitudinally relative to the wireline WL, when the clamping bodies 22, 24 are bolted together. The portion of the wireline passage 38 between the clamping bodies 22, 24 is dimensioned to slightly squeeze the wireline WL, without collapsing it or otherwise damaging it. The vent line passage 40 is dimensioned to allow passage of the vent line VL without squeezing it. As shown in FIG. 2, bolts and bolt holes 44 are provided to bolt together the two halves 12A, 12B of the cutter body 12, in a similar fashion to that contemplated for the clamping bodies 22, 24. Bolting together of the two cutter body halves 12A, 12B facilitates positioning of the cutter knives 18, 20 within the knife chamber 16.

As shown best in FIG. 1, one or more sloping surfaces 46,48 are provided at the lower end of the knife chamber 16, sloping longitudinally and inwardly toward the longitudinal members VL,WL passing through the cutter body 12. The lower ends of the cutter knives 18, 20 abut these sloping surfaces 46, 48. Rather than having two distinct sloping surfaces, a conical sloping surface could be used with a plurality of inwardly facing knives.

The configurations shown in FIGS. 1 and 3 represent the made-up or run-in configuration of the apparatus 10. After the tubular conduit TC and the BHA (not shown) are positioned in the wellbore, it may become necessary to sever the tubular conduit TC, the vent line VL, and the wireline WL above the BHA and retrieve them from the wellbore. After the tubular conduit TC is severed, by any means known in the art, the upper portion of the tubular conduit TC is pulled upwardly, or in the uphole direction.

As shown in FIG. 4, this lifts the cutter body 12 in the uphole direction. Since the cutter knives 18, 20 are clamped in position longitudinally on the wireline WL, the lower end of which is still attached to the BHA, the cutter knives 18, 20 are forced inwardly by the sloping surfaces 46, 48 in the cutter body 12, as the cutter body 12 rises. This forces the cutting edges 34, 36 of the blades 30, 32 toward each other, through the longitudinal members VL, WL, severing them. FIG. 5 shows the overlapping of the cutter blades 30, 32 after the cutter knives 18, 20 have been forced fully inwardly by the sloping surfaces 46, 48. After the severing operation, the upper portions of the external longitudinal members VL, WL can be retrieved from the wellbore.

There were two main issues with the technique described above and the associated FIGS. One issue was the need to run a line cutter into the string to cut it as the preferred technique to sever a portion of the string from the BHA. This added time, cost, and risk to the operation. Apart from this, was that after the string was cut and picked up and the members VL and WL were cut, what remained below the cut location fell into the well and made subsequent fishing operations more difficult, if not impossible, by getting in the way of the retrieving or fishing tools.

The invention in the prior application filed May 20, 2009 addresses these problem areas in the prior design of U.S. Pat. No. 6,997,262. It uses a breakaway coupling that comes apart by a tensile force on the string to part the string. Also, the position of the cutter body or bodies and cutter knife assembly or assemblies is inverted from the previous design. When the string is parted and is pulled up, what happens is that the external longitudinal conduit(s) are tensioned, pulling the knives into the cutting mode, but hanging on to the lower cut portion of the external longitudinal conduit(s) from just below the cut location to the fixation location in the BHA, so that there is no loose end that can fall into the wellbore and disturb subsequent fishing or other operations. In an alternative embodiment, the cutter assembly housing, which houses the cutter knife assemblies, can be a single piece that becomes an integral part of the string to allow more flexibility in the size or number of cutter knife assemblies per housing and allows stacking of chambers or channels (for cutter knife assemblies) while maintaining a lower profile using offset pass-through passages for different lines. Additionally, in an another alternate embodiment, the external longitudinal conduits can be severed either by applying an axial tensile force to the cutter body or bodies or by applying an axial tensile force to the external longitudinal conduit(s), depending on whether the string will be severed above all the housing chambers or severed below all the housing chambers in a prior operation. Those skilled in the art will better understand the invention from a review of the preferred embodiment and the associated drawings while recognizing that the full scope of the invention is given by the appended claims.

SUMMARY OF THE INVENTION

A cutting assembly for external conduits on a tubing string features a breakaway in the string that can be severed with a tensile force. Alternately, the string can be severed above or below the cutter assembly by creating a mechanical cut through the tubular wall using a cutter that is actuated by mechanical, hydraulic, or other means. Preferably each external conduit is run through a cutter housing that is integral with a passage having threaded end connections. Upon severing of the string and applying a pickup force, a tensile force is applied either to the cutter assembly or assemblies or to each external conduit depending on whether the severing of the string happens above or happens below al the cutter knife assembly chambers or channels. The severing can also happen below the cutter housings. The channels can be in banks that are axially spaced using bypass channels to access lower banks. The cutter knife assembly can be a minor image with knives fashioned to cut lines while moving in either axial direction relative to the cutter assembly, thus allowing for a cut of the external longitudinal conduit(s) regardless of where the main tubular conduit is severed. One or more conduits can be cut with a single cutter assembly. The cutter assembly housing is preferably unitary with an off-center passage for the string leaving more space for cable cutter runs of various sizes. Pass-throughs for lines are offset from the cutter runs so that cutter knife assembly chambers or channels can be stacked while still allowing the cutter assembly or assemblies to pass through limited wellbore drift diameters. Complete cutter assemblies can also be stacked in tandem and provide similar benefits.

DETAILED DESCRIPTION OF THE PREFERRED EMBODIMENT

Figure 1:
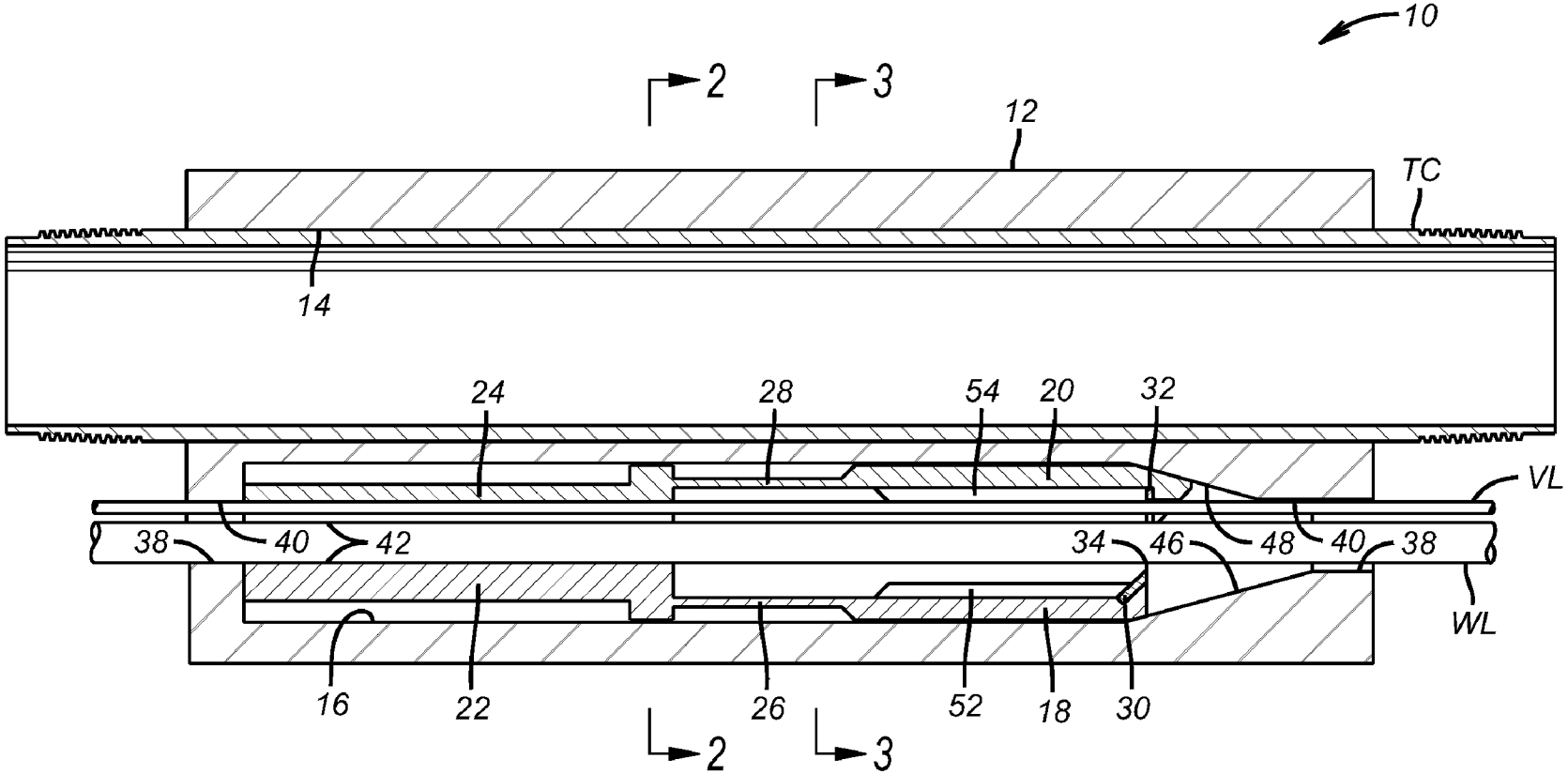
(PRIOR ART) FIG. 1
FIG. 1 is a longitudinal section view of a prior art apparatus (couplers not shown), showing its attachment to a tubular conduit, a vent line, and a wireline.
Figure 3:
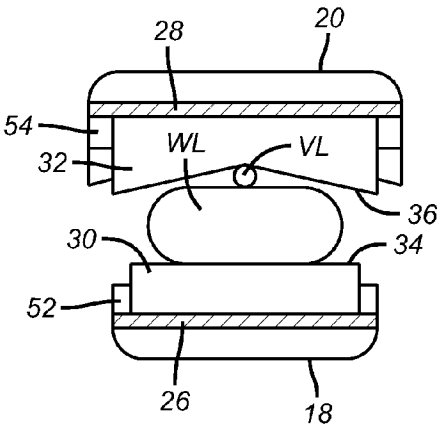
(PRIOR ART) FIG. 3
FIG. 3 is a transverse section view of the apparatus shown in FIG. 1, taken at the line 3-3.
Figure 5:
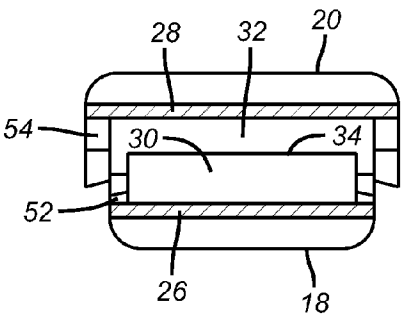
(PRIOR ART) FIG. 5
FIG. 5 is a transverse section view of the apparatus shown in FIG. 4, showing the actuation of the cutter knife assembly's cutter blades.
Figure 2:
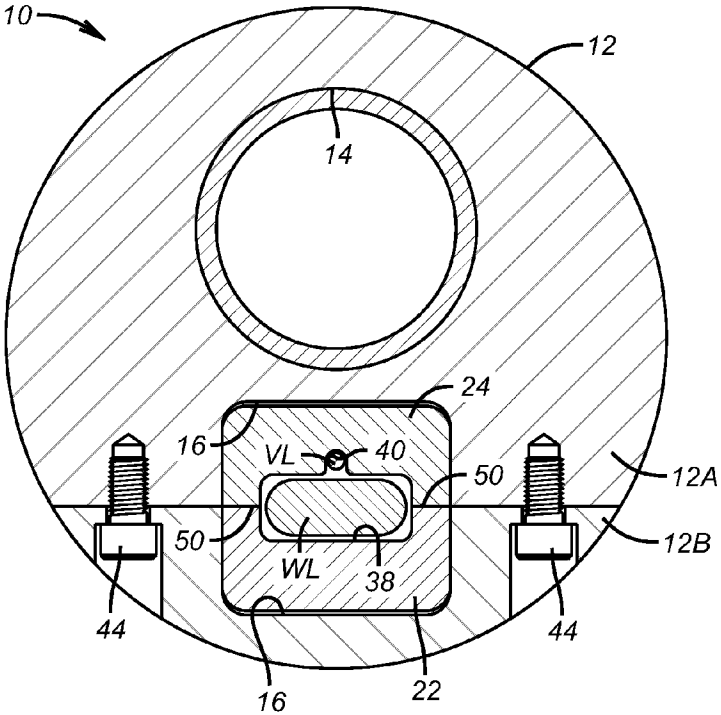
(PRIOR ART) FIG. 2
FIG. 2 is a transverse section view of the apparatus shown in FIG. 1, taken at the line 2-2.
Figure 4:
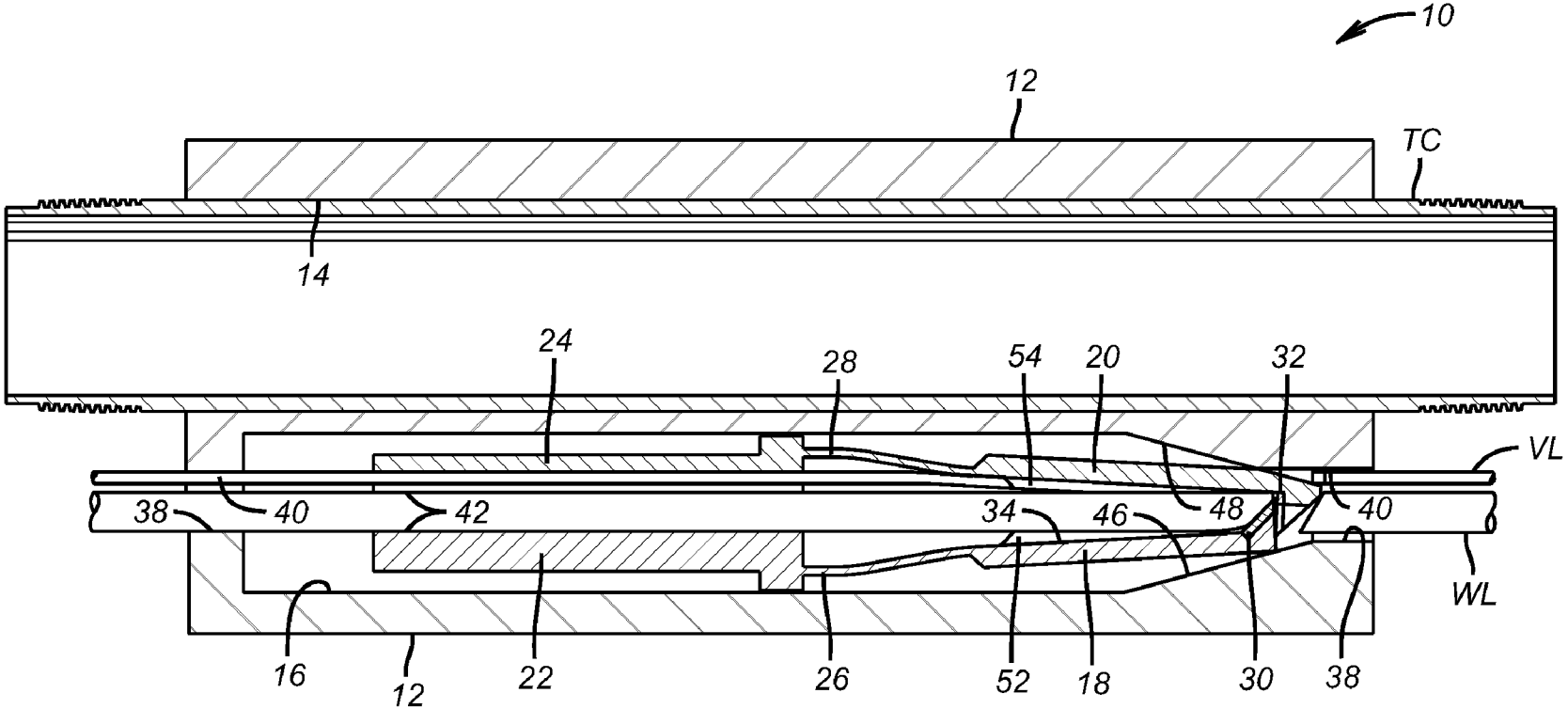
(PRIOR ART) FIG. 4
FIG. 4 is a longitudinal section view of the apparatus showing the actuation of the cutter knife assembly's cutter blades.
Figure 6:
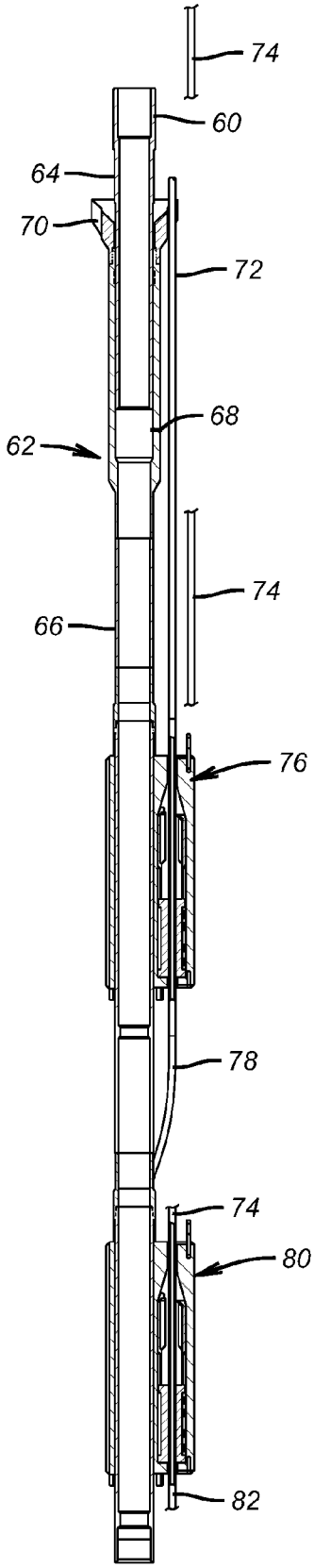
FIG. 6 is a view of the invention claimed in the previous application filed May 20, 2009 shown in a run-in position with multiple cutters for external conduits or lines.

Referring to FIG. 6, a string 60 on a part of which is shown and those skilled in the art will know extends to the surface of a wellbore, features a schematically illustrated breakaway 62 that has an upper component 64 and a sealingly nested lower component 66. As used herein, "breakaway" includes any feature of the string designed to come apart when force is applied as well as the use of external tools that accomplish the same result of separation. They are releasably secured together preferably by one or more shear fastener(s) 68. The invention contemplates a variety of designs with the ultimate objective of separation in the string 60. Accordingly, the separation can be accomplished with an axial force or rotation or combinations of movements such as when a j-slot assembly is used. Alternatively there can be a ball seat on a sleeve that accepts a dropped object to allow pressuring up to accomplish the separation by, for example, breaking a shear fastener in the breakaway 62. Using fluid pressure for the separation can make the assembly serviceable in wells that have some deviation or are non-vertical. In an application using an electric submersible pump (ESP) there is generally little deviation and a breakaway 62 that separates by a pulling force will generally be workable. More deviated applications will likely require a way to hydraulically disconnect the breakaway 62 in the manner discussed above or equivalent techniques.

Figure 9:
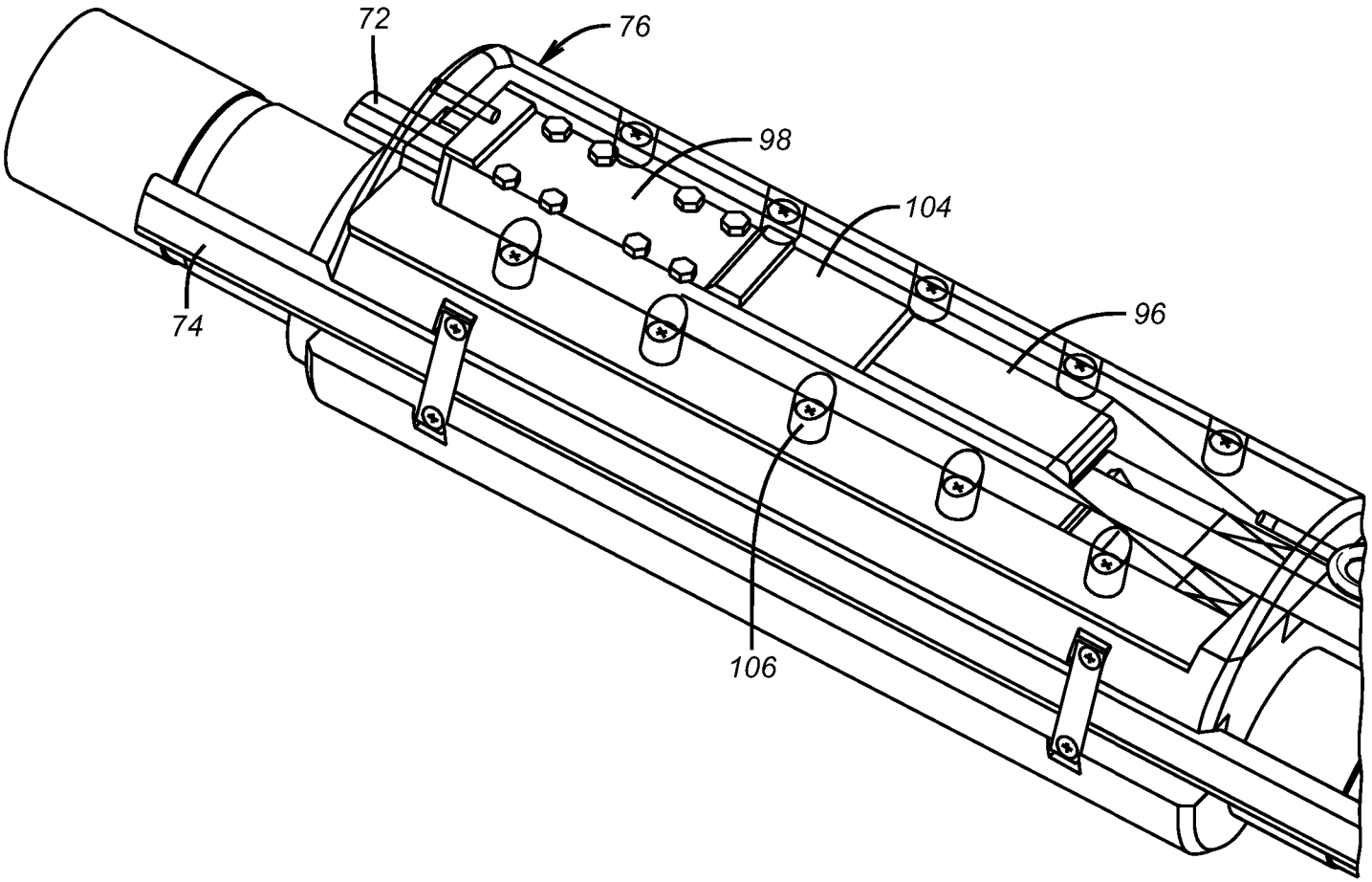
FIG. 9 is a close-up perspective view of FIG. 6 showing a line going from one cutter assembly housing to another cutter assembly housing, passing through and bypassing the cutter knife assembly.

The upper component 64 has a guide 70 through which an external conduit or conduits can be guided. In FIG. 6 conduits 72 and 74 are shown, but to make the FIG. 6 clear, only a part of conduit 74 is illustrated. Conduit 72 extends into a cutter assembly housing 76. It then continues at lower end 78 and bypasses cutter assembly housing 80 to extend to the BHA, which is not shown. Conduit 74 bypasses cutter housing 76 as best shown in FIG. 9, and continues to cutter housing 80. It then has a lower end 82 that continues to the BHA which is not shown. To list a few possibilities, the term "conduit" as used herein can include a variety of structures such as fiber optic cable, power and signal lines, or control lines that covey fluid pressure. While individual conduits are shown associated with a cutter housing 76 and 80, those skilled in the art will appreciate that a single housing can cut one or more conduits.

Figure 7:
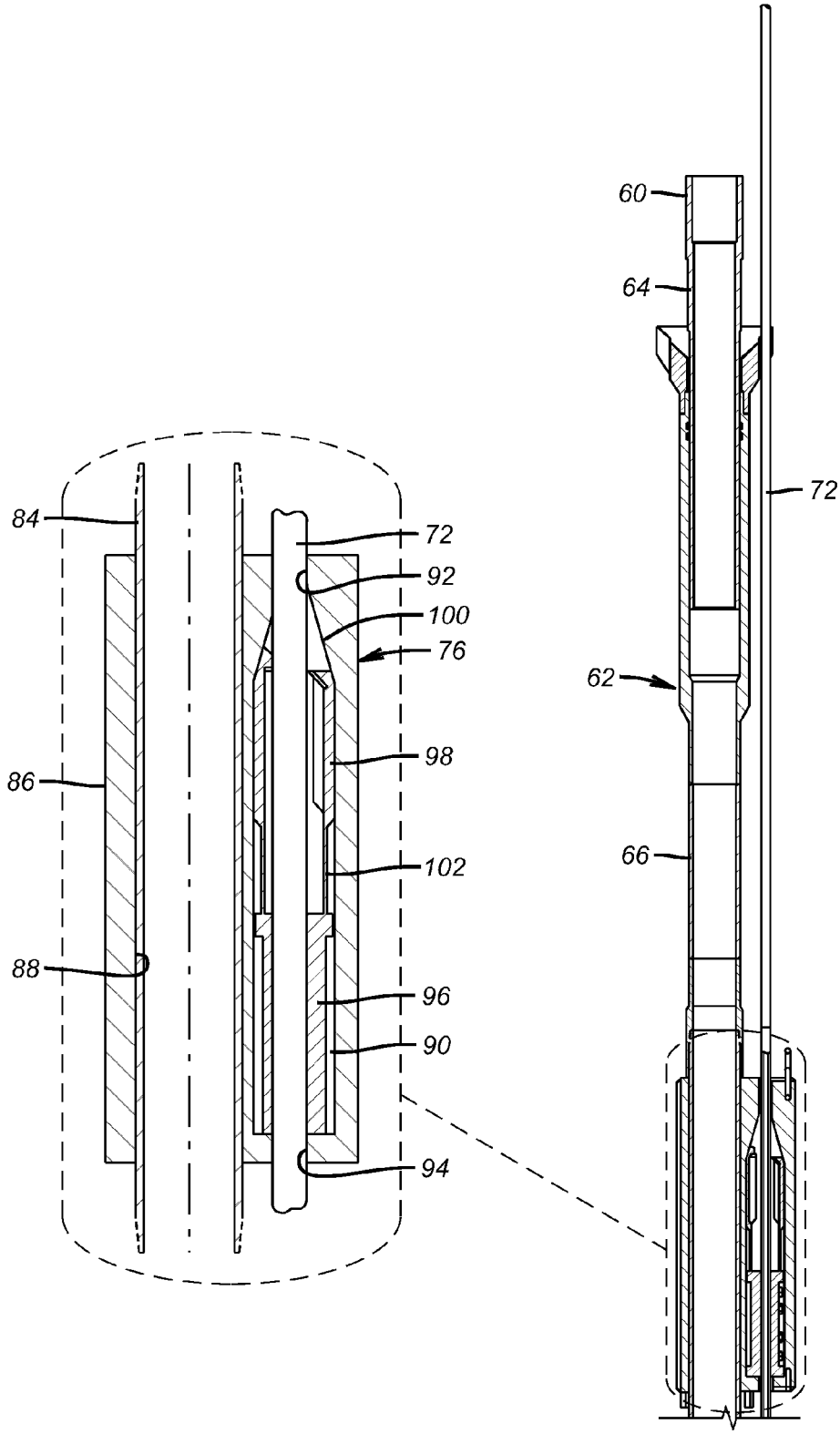
FIG. 7 is the detailed view of FIG. 6 showing a close-up view of a cutter assembly within which is a cutter knife assembly.
Figure 8:
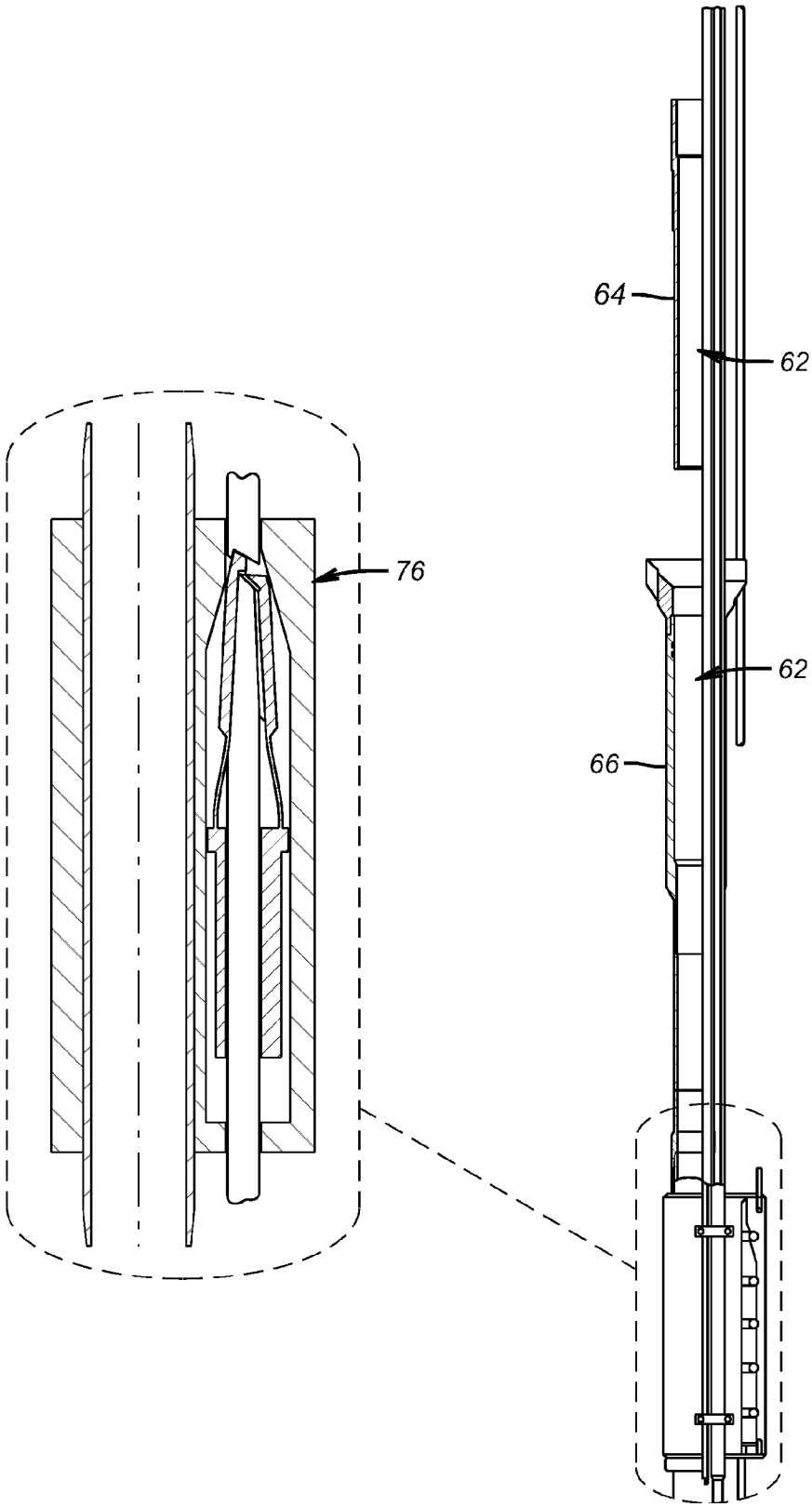
FIG. 8 is a view of the apparatus shown in FIG. 7 showing the breakaway separated and the cutter knife assembly's cutter blades actuated.

The inset in FIG. 7 shows cutter housing 76 in more detail. Preferably, all the cutter housings are identical, but they need not be. A tubular 84, which is part of the string 60, has a housing 86 surrounding it with a through passage 88 so that the tubular 84 can go through the housing 86 and support it. The housing 86 can be supported by collars positioned on each end, or it can be supported by other means. A second passage 90 has an uphole opening 92 and a downhole opening 94 to allow the conduit 72 to pass through. Contained within passage 90 is a grip assembly 96 used to hold the conduit 72 fixed relative to said grip assembly. Above the grip assembly 96 is the knife assembly 98 which has an opening allowing the conduit 72 to be fed continuously through in a direction from opening 92 toward opening 94 while allowing clearance between the knife assembly 98 and the conduit 72 to avoid damaging the conduit 72. The knife assembly 98 is designed to slide up taper 100 when there is a pull force on the conduit 72 to bring the opposed knives together to cut the conduit 72. Grip assembly 96 moves in tandem with knife assembly 98 by virtue of connecting links 102. When the breakaway 62 separates, the lower ends of the conduits, such as 72, remain fixed to the BHA, not shown. Continuously pulling on the string 60 will take out any slack and put tension on all the conduits such as 72 and 74 either at the same time or at delayed time intervals and forces the opposed knives in the knife assembly 98 to come together to cut every conduit, such as 72 and 74, at the same time or at different times. The grip assembly 96 holds on to the lower conduit just cut, such as 72, so that it cannot come out of the lower opening 94 and obstruct the wellbore. After the conduit, such as 72, is cut, the upper portion of the cut conduit, such as 72, will be pulled away from the cutter housing 76 through opening 92. This is shown in FIG. 8 with the breakaway 62 apart and the upper portion 64 at a distance from the fixed lower portion 66.

FIG. 9 shows that a cover 104 is secured with fasteners 106 to secure the grip assembly 96 and the knife assembly 98 in chamber 90 and allow movement such that when a pull force is applied to the conduit, such as 72, in the case of FIG. 9, the movement of the knife assembly 98 will cut the conduit 72 while the grip assembly 96 will move with the conduit 72 until the prescribed cut is made, at which point it will slide back in chamber 90 while retaining the conduit 72 and preventing it from coming out of opening 94 which has remained stationary during the cutting operation.

Those skilled in the art will appreciate that using a breakaway 62 above the cutter housings 76, 80 allows the removal of the upper string 60 to be used to apply tension to the conduits, such as 72, 74 whose lower extensions 78, 82 are fixed by attachment at the BHA, not shown. Applied tension on the conduit 72 advances knife assembly 98 in chamber 90 and actuates the knife assembly 98 to cut said conduit 72. The lower remnants of conduit 72, after the cut, are retained in chamber 90 by the grip assembly 96. While a single conduit is shown to be cut and retained in a dedicated housing, those skilled in the art will appreciate that a single housing can cut multiple conduits. While it is preferred that the workings of the assemblies in the cutter assembly housings 76 and 80 are identical, variations among them can be made to suit the need of the specific conduit that needs to be cut in a given housing. The breakaway 62 can be actuated with a variety of mechanical movements of string 60 that break shear fasteners, for example, or it can be hydraulically actuated with a sleeve that can be shifted with fluid pressure to break a fastener that holds the breakaway 62 together and can thereafter be blown through as a ball on seat assembly or the ball can be blown through the seat to the BHA. The end result of the invention is that the string 60 can be quickly separated and there are no cut conduit remnants that can fall in the wellbore and obstruct it to make subsequent fishing or other operations more difficult.

Figure 10:
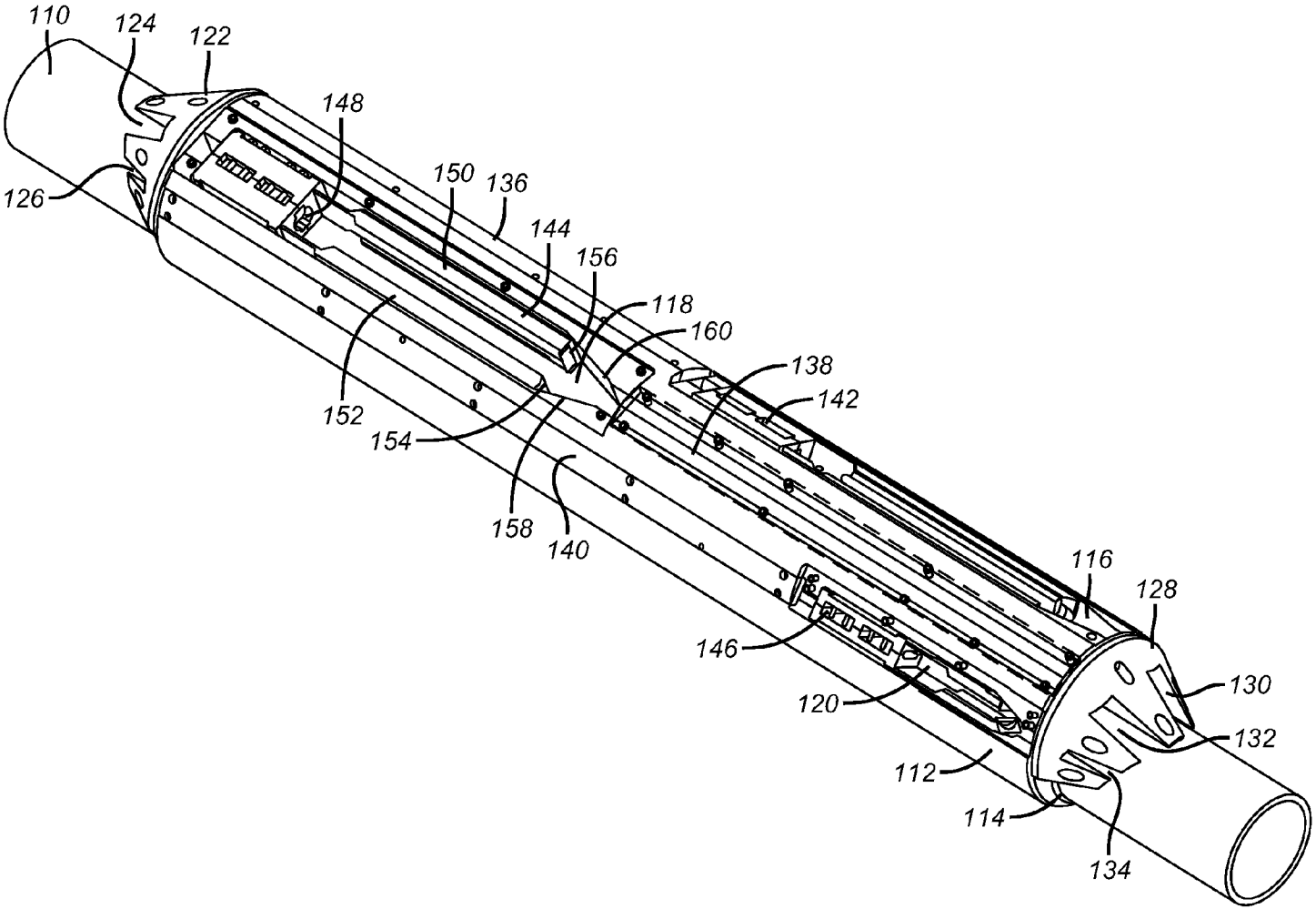
FIG. 10 is an alternative embodiment showing the unitary cutter assembly housing in part cutaway perspective view with three illustrated cutter runs of varying sizes.

FIG. 10 illustrates a string joint 110 made as one piece with a cutter assembly housing 112 having a passage 114 that is off-center. The housing has shown three passages 116, 118 and 120 that extend longitudinally. Visible at the top 122 are entrances 124 and 126 that lead to passages 118 and 120. At the bottom 128 are exits 130, 132 and 134 that respectively lead from passages 116, 118 and 120. Ends 122 and 130 are tapered to facilitate running into or coming out of the hole.

Passage 118 is the widest for the largest cable or line and it located at the 12 o'clock position, where there exists the most room for that passage due to the offset location of passage (opening) 114 on which the threaded connection to which the string is connected is formed. Portions of the passages 116, 118 and 120 have respective covers 136, 138 and 140 either above or below the cutter knife assemblies 142, 144 and 146 depending on the cutter knife assembly placements. There are also covers over the cutter knife assemblies 142, 144 and 146 as well. Except for size differences, the cutter knife assemblies 142, 144 and 146 are similar in that they have a guide passage 148 that grips the line or cable (not shown) with a pair of extending members 150 and 152 that hold a cutter blade 154 or/and 156 at the ends. The cutter blades 154 and 156 are brought together around the line to be cut that is between them (not shown) as the ramps 158 and 160 get pulled up as the string 110 is severed below as was previously described for the design of U.S. Pat. No. 6,997,262. Depending on the slack of the lines to be cut, the cutting action can be at the same time or at discrete times as the string 110 is picked up after it is severed.

Figure 11:
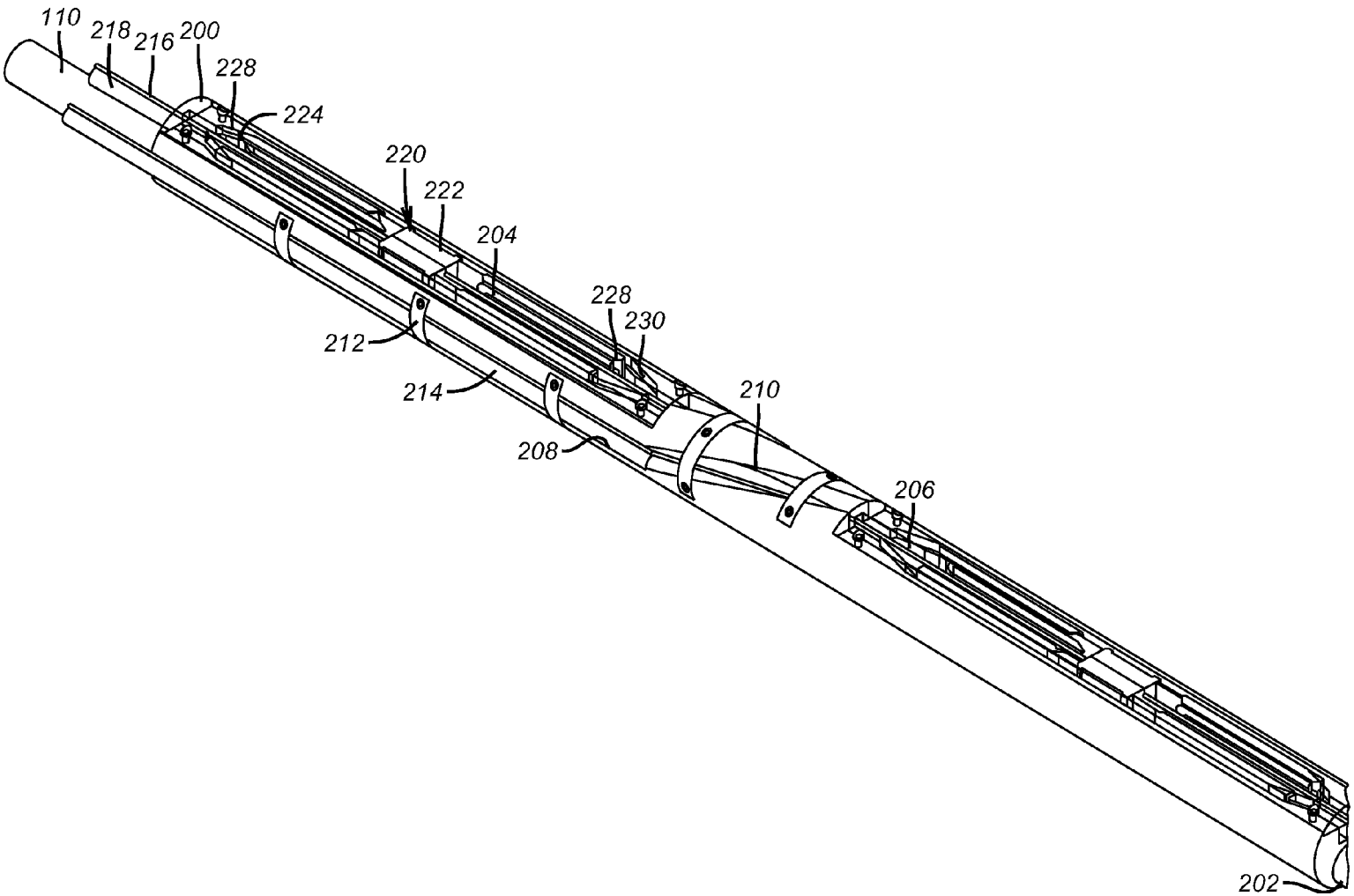
FIG. 11 is part cutaway perspective view showing stacked cutter knife assembly chambers or channels, their respective cutter knife assemblies therein, and bypass channels or runs, all in a unitary cutter assembly housing.

FIG. 11 shows the same joint 110 made of a single piece with a cutter assembly housing 200 with an off-center opening 202. As opposed to FIG. 10 where the housing 112 had but a single row of parallel tracks or passages such as 116, 118 and 120, in FIG. 11 there are axially spaced banks of passages such as 204 and 206 both at the 12 o'clock position so that they can have a larger size than other passages that can be run parallel to them say at the 10 o'clock or 2 o'clock positions. The one or more passage in the upper bank such as 204 can be bypassed to reach the lower bank with its one illustrated passage 206 through one or more bypass grooves such as 208 which preferably have a dog leg such as 210 so that like sized line cutting passages can be longitudinally aligned regardless of the number of such passages in the lower bank. As between banks, the number of passages can be the same or different and longitudinal alignment is not required. Straps or bands 212 hold in line 214 in bypass passage 208 or in dog leg 210. The outside diameter of the housing 200 for the particular application and the size of the lines that need to run in the cutting passages will determine the layout and number of banks that will fit in a given application. It should also be noted that the lines can be ganged up in a given passage. For example lines 216 and 218 run together into a cutter knife assembly 220 that is a minor image layout. It has a hub 222 that includes stacked line pass through openings. One or more cutter blades 224 are near the upper end and one or more cutters 226 are near the lower end. Cutter blades 224 interact with ramps 228 and cutter blades 226 interact with ramps 230. If the break point in the string is below joint 110, then forcing that separation there and picking up the joint 110 will pick up the ramp surfaces 230 and force together the cutter blade or cutter blades 226. Alternatively, a second breakaway location can be above the joint 110 and set at a higher break force value before it comes apart. This configuration provides a retrieval contingency for a BHA positioned below a stuck or lodged cutting assembly. When the break in the string is above the joint 110, picking up on the string pulls tension on the lines 216 and 218 and brings the cutter blade or cutter blades 224 near the tapered surfaces 228 to make the cut in an alternative way. Thus, if necessary, the cutter assembly and any BHA attached thereto can be retrieved with relative ease in a subsequent operation. In the preferred embodiment each cutter assembly 224 or 226 cuts a single line or conduit that is disposed adjacent a blade or blade pair. However, other arrangements are envisioned such as a blade or blade pair at each end of a cutter knife assembly cutting into the same line or cable to ensure it gets cut. More than one cable can be cut at tapers 228 or 230.

The above description is illustrative of the preferred embodiment and many modifications may be made by those skilled in the art without departing from the invention whose scope is to be determined from the literal and equivalent scope of the claims below.

We claim:

1. A tubular string assembly extending from a surface to a subterranean location, comprising:

at least one tubular string having a plurality of joints and having at least one external conduit extending alongside, said conduit being retained at a predetermined location to said string;

said conduit extending through at least one cutter housing, said cutter housing fabricated with a passage therethrough and tubular end connections on said passage such that said cutter housing can be secured as a joint in said string;

whereupon relative movement between said conduit and said string in either of opposed directions said conduit is cut by discrete cutter knife assemblies in said cutter housing;

said cutter knife assemblies each comprises one or more cutter blades.

2. The assembly of claim 1, wherein:

said passage has a centerline that is off-center to the centerline of said cutter housing.

3. The assembly of claim 2, wherein:

said cutter housing has at least one exterior passage or channel through which at least one said conduit passes;

said exterior passage or channel contains said cutter knife assemblies with opposite orientations.

4. The assembly of claim 3, wherein:

said exterior passage or channel is spaced on an opposite side of the center of said cutter housing than the center of said passage.

5. The assembly of claim 4, wherein:

said exterior passage or channel comprises a plurality of exterior passages or channels running substantially parallel to each other and circumferentially spaced.

6. The assembly of claim 5, wherein:

said passages or channels are different sizes and have different sized conduits running therethrough.

7. The assembly of claim 5, wherein:

a plurality of said passages or channels has at least one cutter knife assembly per passage or channel straddling said conduits that run through said passages or channels;

said cutter knife assembly is actuated by contact with at least one taper in said channels upon relative movement between said cutter knife assembly and said cutter housing.

8. The assembly of claim 7, wherein:

said conduit passes through an opening in a body of said cutter knife assembly and a pair of elongated members extending in a first direction from said cutter knife assembly body to space apart at least one first blade from said cutter knife assembly body;

said first cutter blade cuts said conduit upon contact with a first said taper by said elongated members supporting said first cutter blade when relative movement between said conduit and said cutter housing is in a first direction.

9. The assembly of claim 7, wherein:

said relative movement is enabled by actuating at least one break away located in said string.

10. The assembly of claim 9, wherein:

said breakaway is located on said string closer to the surface than said cutter housing.

11. The assembly of claim 1, wherein:

said exterior channels further comprise removable covers and said cutter housing has end members with external tapers and openings to allow said conduit to enter and exit a respective channel.

12. A tubular string assembly extending from a surface to a subterranean location, comprising:

at least one tubular string having a plurality of joints and having at least one external conduit extending alongside, said conduit being retained at a predetermined location to said string;

said conduit extending through at least one cutter housing, said cutter housing integrally fabricated with a passage therethrough and tubular end connections on said passage such that said cutter housing can be secured as a joint in said string;

whereupon relative movement between said conduit and said string said conduit is cut by at least one cutter knife assembly in said cutter housing;

said cutter knife assembly comprises one or more cutter blades;

said passage has a centerline that is off-center to the centerline of said cutter housing;

said cutter housing has at least one exterior passage or channel through which at least one said conduit passes;

said exterior passage or channel is spaced on an opposite side of the center of said cutter housing than the center of said passage;

said exterior passage or channel comprises a plurality of exterior passages or channels running substantially parallel to each other and circumferentially spaced;

a plurality of said passages or channels has at least one cutter knife assembly per passage or channel straddling said conduits that run through said passages or channels;

said cutter knife assembly is actuated by contact with at least one taper in said channels upon relative movement between said cutter knife assembly and said cutter housing;

said conduit passes through an opening in a body of said cutter knife assembly and a pair of elongated members extending in a first direction from said cutter knife assembly body to space apart at least one first blade from said cutter knife assembly body;

said first cutter blade cuts said conduit upon contact with a first said taper by said elongated members supporting said first cutter blade when relative movement between said conduit and said cutter housing is in a first direction;

said conduit passes through a second pair of elongated members extending in a second direction from said cutter knife assembly body that is opposite said first direction to space apart at least one second cutter blade from said cutter knife assembly body;

said second cutter blade cuts said conduit upon contact with a second said taper by said second pair of elongated members supporting said second cutter blade when relative movement between said conduit and said cutter housing is in a second direction opposite said first direction.

13. The assembly of claim 12, wherein:

said relative movement in said first direction is enabled by actuating at least one break away located in said string further from the surface than said cutter housing.

14. The assembly of claim 12, wherein:

said relative movement in said first direction is enabled by actuating at least one break away located in said string closer to the surface than said housing.

15. A tubular string assembly extending from a surface to a subterranean location, comprising:

at least one tubular string having a plurality of joints and having at least one external conduit extending alongside, said conduit being retained at a predetermined location to said string;

said conduit extending through at least one cutter housing, said cutter housing integrally fabricated with a passage therethrough and tubular end connections on said passage such that said cutter housing can be secured as a joint in said string;

whereupon relative movement between said conduit and said string said conduit is cut by at least one cutter knife assembly in said cutter housing;

said cutter knife assembly comprises one or more cutter blades;

said passage has a centerline that is off-center to the centerline of said cutter housing;

said cutter housing has at least one exterior passage or channel through which at least one said conduit passes;

said exterior passage or channel is spaced on an opposite side of the center of said cutter housing than the center of said passage;

said exterior passage or channel comprises a plurality of exterior passages or channels running substantially parallel to each other and circumferentially spaced;

a plurality of said passages or channels has at least one cutter knife assembly per passage or channel straddling said conduits that run through said passages or channels;

said cutter knife assembly is actuated by contact with at least one taper in said channels upon relative movement between said cutter knife assembly and said cutter housing;

at least one bypass channel running alongside and past said passages or channels having a cutter knife assembly in them to at least a second tier channel having a cutter knife assembly therein.

16. The assembly of claim 15, wherein:

said second tier channel is axially aligned with said passages or channels that are spaced apart from it.

17. The assembly of claim 16, wherein:

said at least one bypass channel comprises a plurality of bypass channels leading to a plurality of second tier channels that are substantially parallel to each other.

18. The assembly of claim 17, wherein:

each said conduit passes through an opening in a respective body of said cutter knife assembly and a pair of elongated members extending in a first direction from said cutter knife assembly body to space apart at least one first cutter blade from said cutter knife assembly body;

said first cutter blade cuts said conduit upon contact with said taper by said elongated members supporting said first cutter blade when relative movement between said conduit and said cutter housing is in a first direction.

19. The assembly of claim 18, wherein:

each said conduit passes through a second pair of elongated members extending in a second direction from said cutter knife assembly body that is opposite said first direction to space apart at least one second cutter blade from said cutter knife assembly body;

said second cutter blade cuts said conduit upon contact with said taper by said second pair of elongated members supporting said second blade when relative movement between said conduit and said cutter housing is in a second direction opposite said first direction.

20. A tubular string assembly extending from a surface to a subterranean location, comprising:

at least one tubular string having a plurality of joints and having at least one external conduit extending alongside, said conduit being retained at a predetermined location to said string;

said conduit extending through at least one cutter housing, said cutter housing integrally fabricated with a passage therethrough and tubular end connections on said passage such that said cutter housing can be secured as a joint in said string;

whereupon relative movement between said conduit and said string said conduit is cut by at least one cutter knife assembly in said cutter housing;

said cutter knife assembly comprises one or more cutter blades;

said passage has a centerline that is off-center to the centerline of said cutter housing;

said cutter housing has at least one exterior passage or channel through which at least one said conduit passes;

said exterior passage or channel is spaced on an opposite side of the center of said cutter housing than the center of said passage;

said exterior passage or channel comprises a plurality of exterior passages or channels running substantially parallel to each other and circumferentially spaced;

a plurality of said passages or channels has at least one cutter knife assembly per passage or channel straddling said conduits that run through said passages or channels;

said cutter knife assembly is actuated by contact with at least one taper in said channels upon relative movement between said cutter knife assembly and said cutter housing;

said relative movement is enabled by actuating at least one break away located in said string;

said breakaway is located on said string further from the surface than said cutter housing.

21. A tubular string assembly extending from a surface to a subterranean location, comprising:

at least one tubular string having a plurality of joints and having a plurality of external conduits extending alongside, said conduits being retained at a predetermined location to said string;

said conduits extending through at least one cutter housing, said cutter housing fabricated with a passage therethrough and tubular end connections on said passage such that said cutter housing can be secured as a joint in said string;

said cutter housing has a plurality of exterior passages or channels through which at least one said conduit passes;

whereupon relative movement between said conduit and said string said conduits are cut by at least one cutter knife assembly in each said exterior passage or channel in said cutter housing;

said cutter knife assembly comprises one or more cutter blades;

said cutter knife assemblies in different exterior passages or channels being axially spaced and generally aligned so that one said exterior passage or channel runs generally parallel to another said exterior passage or channel, both exterior channels or passages having bends.

22. The assembly of claim 21, wherein:

said passage has a centerline that is off-center to the centerline of said cutter housing.

23. The assembly of claim 22, wherein:

said exterior passage or channel is spaced on an opposite side of the center of said cutter housing than the center of said passage.

24. The assembly of claim 23, wherein:

said exterior passage or channel comprises a plurality of exterior passages or channels running substantially parallel to each other and circumferentially spaced.

25. The assembly of claim 24, wherein:

said passages or channels are different sizes and have different sized conduits running therethrough.

26. The assembly of claim 24, wherein:

a plurality of said passages or channels has at least one cutter knife assembly per passage or channel straddling said conduits that run through said passages or channels;

said cutter knife assembly is actuated by contact with at least one taper in said channels upon relative movement between said cutter knife assembly and said cutter housing.

27. The assembly of claim 26, wherein:

said conduit passes through an opening in a body of said cutter knife assembly and a pair of elongated members extending in a first direction from said cutter knife assembly body to space apart at least one first blade from said cutter knife assembly body;

said first cutter blade cuts said conduit upon contact with a first said taper by said elongated members supporting said first cutter blade when relative movement between said conduit and said cutter housing is in a first direction.

28. The assembly of claim 26, wherein:

said relative movement is enabled by actuating at least one break away located in said string.

29. The assembly of claim 28, wherein:

said breakaway is located on said string closer to the surface than said cutter housing.

30. The assembly of claim 21, wherein:

said exterior channels further comprise removable covers and said cutter housing has end members with external tapers and openings to allow said conduit to enter and exit a respective channel.

* * * * *